US005482175A

United States Patent [19]

Arrar

[11] Patent Number: 5,482,175

[45] Date of Patent: Jan. 9, 1996

[54] PRESSURIZED CONTAINER TOP

[76] Inventor: Naseem B. Arrar, Salhiya Complex Mezzanine 2 Entrance 1, P.O. Box 26636, Safat, Kuwait

[21] Appl. No.: 175,194

[22] Filed: Dec. 28, 1993

[51] Int. Cl.[6] ..... B65D 17/30; B65D 51/22; B21D 51/44

[52] U.S. Cl. ..... 220/203.08; 220/267; 220/281; 222/206; 413/12; 413/67

[58] Field of Search ..... 220/202, 203, 220/207, 266, 281, 666, 667, 907, 267, 265, 203.08, 203.09; 222/209, 206; 413/12, 8, 2, 67, 78; 229/125.14, 123.2

[56] References Cited

U.S. PATENT DOCUMENTS

| | | | |
|---|---|---|---|
| 1,847,108 | 3/1932 | Hirsch et al. | 413/12 |
| 2,147,004 | 2/1939 | Wark et al. | 220/258 |
| 4,632,298 | 12/1986 | Schellenberg | 220/258 X |
| 4,938,390 | 4/1990 | Markva | 222/206 |

FOREIGN PATENT DOCUMENTS

| | | | |
|---|---|---|---|
| 2025888 | 1/1980 | United Kingdom | 220/258 |

*Primary Examiner*—Allan N. Shoap
*Assistant Examiner*—Nathan Newhouse
*Attorney, Agent, or Firm*—Allen, Dyer, Doppelt, Franjola & Milbrath

[57] ABSTRACT

A pressurized container end has a frangible member covering an opening in the end. The frangible member is cut away from the end by the action of increased pressure from within the container against the member. A protrusion in a portion of the end is depressed into the container for increasing pressure in the container. In an alternate form of the invention, the container itself is depressed inwardly for causing the increased pressure sufficient to cut the frangible member away from the end. Various opening geometries are each formed with a cutting edge.

21 Claims, 3 Drawing Sheets

PRESSURIZED CONTAINER TOP

BACKGROUND OF INVENTION

1. Field of Invention

The invention relates generally to easy opening tops for containers, and more particularly to pressurized container tops employing pressure increases to form an opening through which contents of the container can be transferred.

2. Background Art

An easy open container is generally described as one in which an end of the container can be opened without using a can opener or similar tool. U.S. Pat. No. 5,069,356 issued to E. H. Zysset on Dec. 3, 1991 discloses an easy open end panel including a pull tab fixed to a removable inside portion of the panel. The end panel has score lines in the panel defining removable an inside panel portion which is severed from a remaining outside portion of the panel. The pull tab is fixed along one side of the removable inside portion of the panel. The entire inside panel portion is then removed by simply pulling the tab outwardly to complete severing along the score line.

U.S. Pat. No. 3,952,912 issued to W. M. Perry on Apr. 27, 1976 discloses a container having a lift tab for easy opening. A closure is sealed by a frangible adhesive sealant.

U.S. Pat. No. 3,472,415 issued to S. R. Woodruff on Oct. 14, 1969 discloses a receptacle and push type opener. The opener is a V-shaped tab, the side edges of which allow the tab to be pushed inwardly hinging about the base of the V. A thin frangible material is provided as a layer on the underside of the can lid which is sheared by the edges of the V-shaped tab as it moves inwardly to provide the opening.

SUMMARY OF INVENTION

An easy open container comprises a panel affixed to a pressurized container wherein the panel comprises a panel portion with an opening for passing contents of the container therethrough. A frangible member is across the opening of the panel portion and means is provided for increasing pressure within the pressurized container for rupturing the frangible member outwardly from the container and away from the panel.

In one embodiment, the increasing pressure means comprises a second panel portion spaced from the panel portion across the panel and a depressible protrusion extending from the panel along the second panel portion, wherein depression of the depressible portion causes increased pressure within the container sufficient for outwardly rupturing the frangible member. In an alternate embodiment, the increasing pressure means comprises the container having side walls formed from material for depressing the side walls into the container, wherein the depressing of the side walls causes increased pressure within the container sufficient for rupturing the frangible member.

The container opening further comprises a cutting edge portion extending into the container wherein the cutting edge portion is biased against the frangible member. In an alternate use of the frangible member, the frangible member is placed across the entire panel for providing a seal between the panel and the pressurized container. The frangible member comprises a sealing liner sheet having a pressure sensitive adhesive for affixing the sheet to the panel.

In alternate embodiments of the opening, the opening comprises a distinguishable geometric form. The pressurized container is dimensioned in alternate uses for holding liquids and solid objects sized to pass through the opening. In the preferred embodiment, the container is dimensioned to be held in a hand for pouring material contained within the container out through the opening.

An easy open end for a pressurized container is disclosed comprising an end panel having spaced first and second panel portions across the panel. The first panel portion has an opening wherein a frangible member is across the opening of the first panel portion. Means for increasing pressure against the frangible member is provided when the end panel is affixed to a pressurized container. The increased pressure causes the frangible member to rupture outwardly from the container and away from the panel.

A method for easily opening a container is disclosed wherein the method comprises the steps of providing a pressurized container, affixing a panel to the pressurized container wherein the panel portion has an opening for passing contents of the container therethrough, placing a frangible member across the opening of the panel portion, and increasing pressure within the pressurized container for rupturing the frangible member outwardly from the container and away from the panel.

In one embodiment of the invention, the method comprises forming a depressible protrusion extending from the panel along a second panel portion and depressing the depressible portion for increasing pressure within the container sufficient for rupturing the frangible member outwardly from the container and away from the panel. In another embodiment, the method comprises the step of increasing pressure by depressing walls of the container into the container for increasing pressure within the container sufficient for rupturing the frangible member outwardly from the container and away from the panel.

It is a primary object of the invention to provide an easy opening pressurized container. It is a further object to provide opening means wherein a frangible material is ruptured away from the contained using an increase in pressure within the container. It is further an object of the invention to provide means for increasing pressure within the container top panel and alternately in the container wherein the container walls are depressed for causing the pressure increase. It is another object of the invention to provide alternate opening geometries.

BRIEF DESCRIPTION OF DRAWINGS

A preferred embodiment of the invention as well as alternate embodiments are described by way of example with reference to the accompanying drawings in which.

DETAILED DESCRIPTION OF PREFERRED EMBODIMENT

Figure 1:
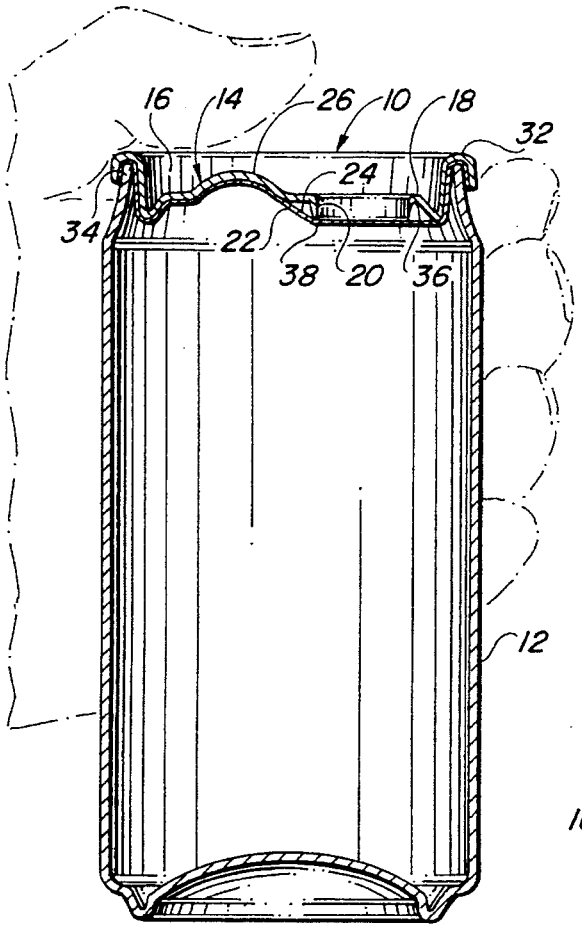
FIG. 1 is a partial cross-sectional view of the preferred embodiment of the invention illustrating a container dimensioned to fit within a hand.
Figure 2:
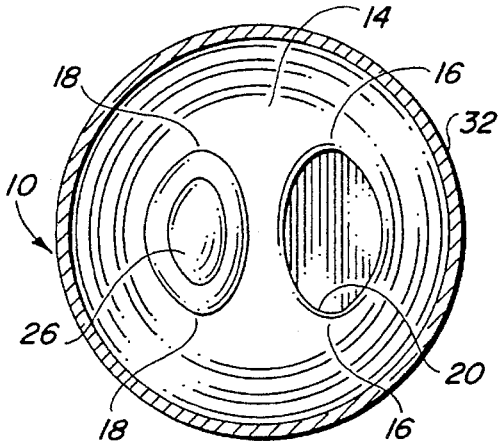
FIG. 2 is a top view of the container illustrating a portion of an end panel having a protrusion and another portion having an opening, a frangible member affixed across the panel.
Figure 3:
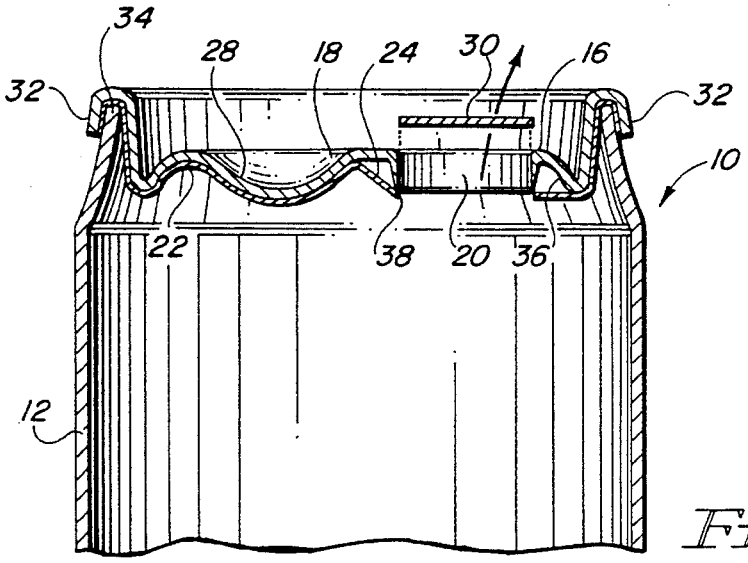
FIG. 3 is a partial cross-sectional view of the invention illustrating a depressed protrusion and a resulting ruptured frangible member.

In a preferred embodiment of the invention as illustrated in FIG. 1, an easy open pressurized container 10 comprises a pressurized container 12 having a panel 14 forming a portion of the container 10. The panel 14 comprises a first panel portion 16 spaced from a second panel portion 18 as illustrated in FIG. 2. The first panel portion 16 has an opening 20 formed therein. In the preferred embodiment of the invention, a frangible sheet member 22 comprises a pressurized adhesive side 24 which is affixed to the panel 14. The sheet member 22 bridges the opening 20. A protrusion 26 is formed in the second panel portion 18. A smooth dome shaped protrusion 26 is described in the preferred embodiment, however, it is anticipated that various shaped contours will be implemented. With reference to FIG. 3, the protrusion is dimensioned such when the protrusion 26 is depressed and pushed into the container 12, the increased pressure created by the depressed protrusion 28 is sufficient to rupture a frangible sheet member portion 30 bridging the opening 20.

As described for the preferred embodiment, the frangible sheet member 22 is across the panel 14. With this arrangement and the pressurized container 12 illustrated by way of example in this specification, the panel 14 provides a top with a flanged peripheral portion 32 dimensioned to be crimped onto the a container edge 34. In this way, the frangible sheet member 22 provides a seal between the container 12 and the panel 14. The pressure sensitive adhesive side 24 of the sheet member 22 adheres to the inside panel surface 36 across the entire surface except for the portion 30 across the opening 20.

In the preferred embodiment of the invention, as illustrated in FIGS. 1 and 3, the opening 20 comprises a cutting edge 38 extending into the container 12 and biasing against the frangible sheet member 22. The pressure in the container 12 sufficiently biases the frangible sheet member 22 against the cutting edge 38 to form a seal between the edge 38 and the member 22 but such pressure is insufficient to rupture the member 22. As described, the increased pressure caused by the depressed protrusion 28 reducing container volume and thus increasing container pressure provides the sufficient pressure to rupture the member 22. The member 22 is thus ruptured into its frangible member portion 30 for dispensing contents of the container 12.

In the preferred embodiment of the container 10 herein described, the frangible sheet member 22 is described in combination with the cutting edge 38 rupturing the member 22. It is anticipated that member 22 having various thicknesses and frangible strength will be used in combination with edges 38 having varying degrees of sharpness for rupturing the member 22.

Figure 5:
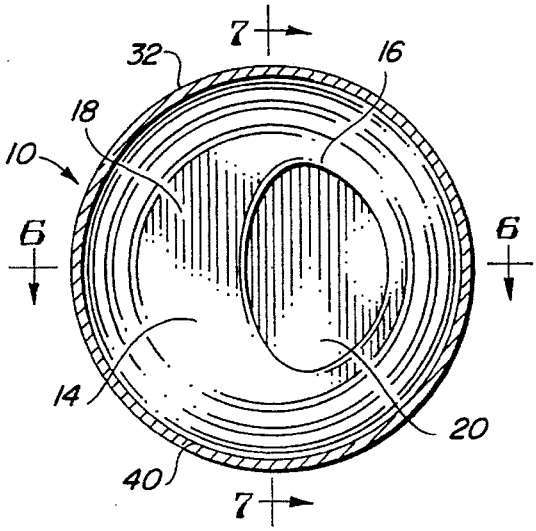
FIG. 5 is a top view of the embodiment illustrated in FIG. 4.
Figure 4:
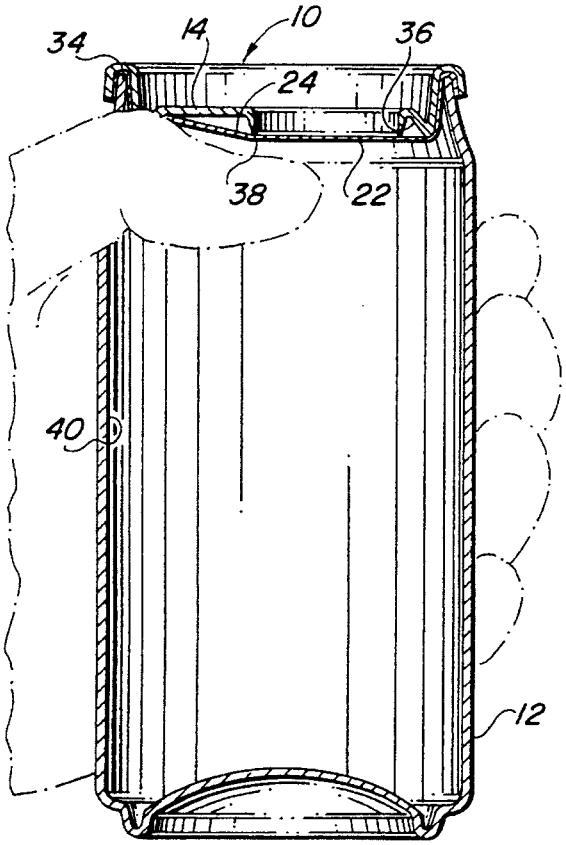
FIG. 4 is a partial cross-sectional view of an alternate embodiment of the invention dimensioned to fit within a hand wherein the panel has an opening and frangible member across the panel.
Figure 6:
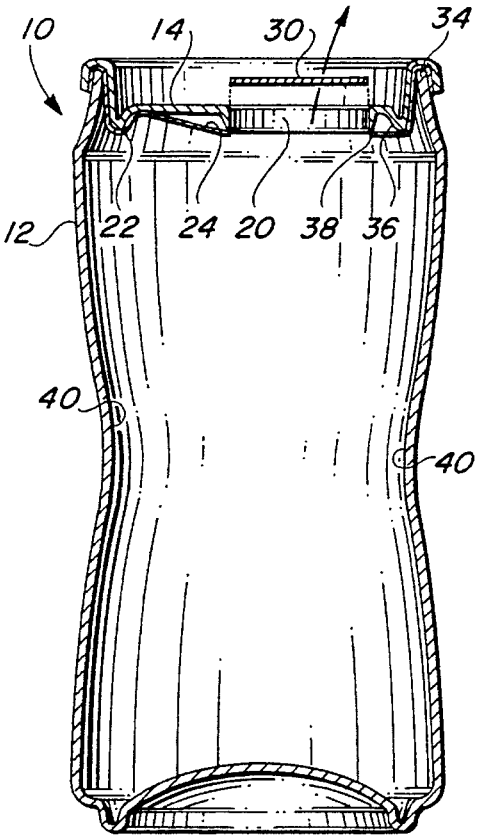
FIG. 6 is a partial cross-sectional view of the alternate embodiment shown in FIG. 4 wherein walls of the container are depressed resulting in the rupturing of the frangible member away from the container end panel.

With reference to FIGS. 4 through 6, an alternate embodiment of the invention is described wherein the panel 14 comprises an opening 20 and a frangible sheet member 22 across the panel 14. In this embodiment, the container 12 is made from a material that permits the container 12 to have its walls 40 depressed such that pressure in the container is increased sufficiently to rupture the frangible sheet member 22 and thus remove the ruptured frangible member portion 30 away from the container 12.

In this case, the walls 40 are sufficiently flexible such that after being deformed, they reform into their original position.

Figure 7A:
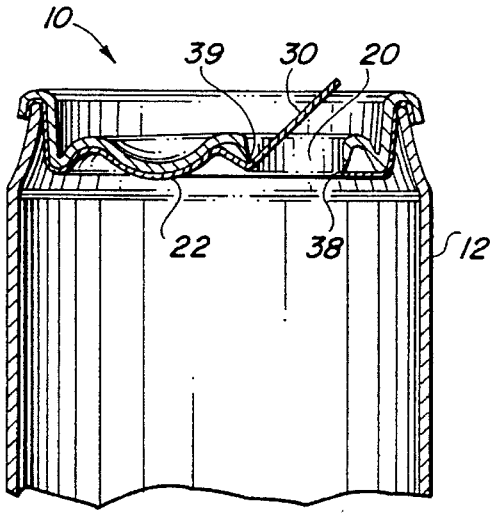
FIG. 7*a* and 7*b* illustrate an alternate embodiment of the invention illustrating the frangible member portion partialy fixed to the sheet member.
Figure 7B:
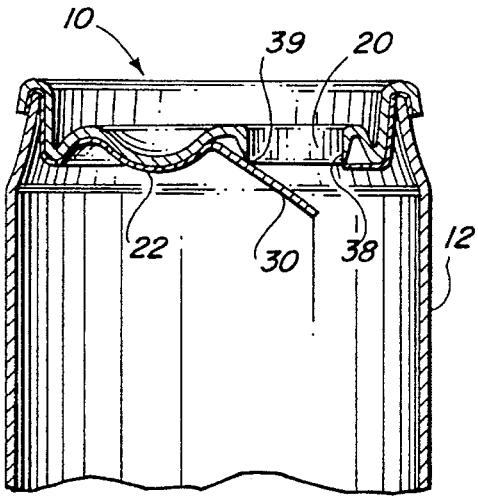
Figure 8A:
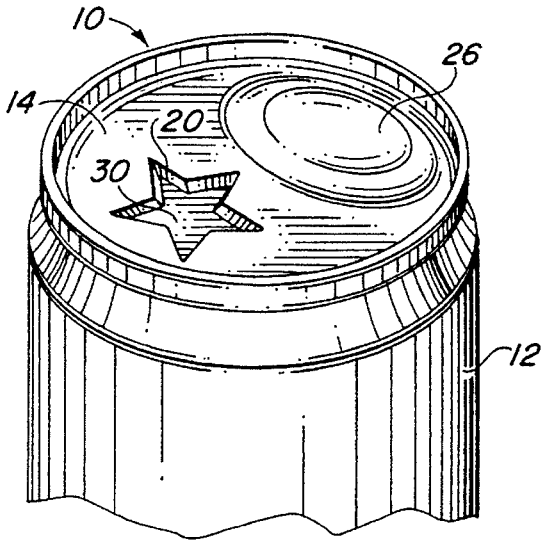
FIG. 8*a* through 8*d* are partial perspective views of the container end panel comprising openings of varying geometries.
Figure 8B:
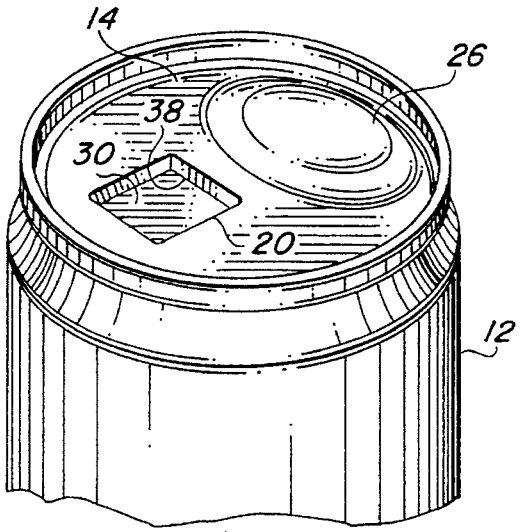
Figure 8C:
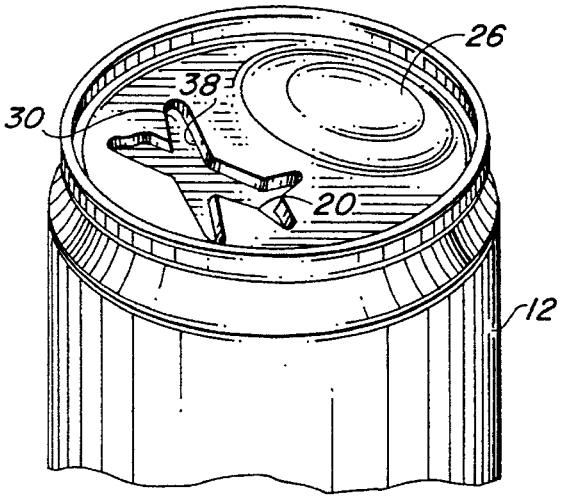
Figure 8D:
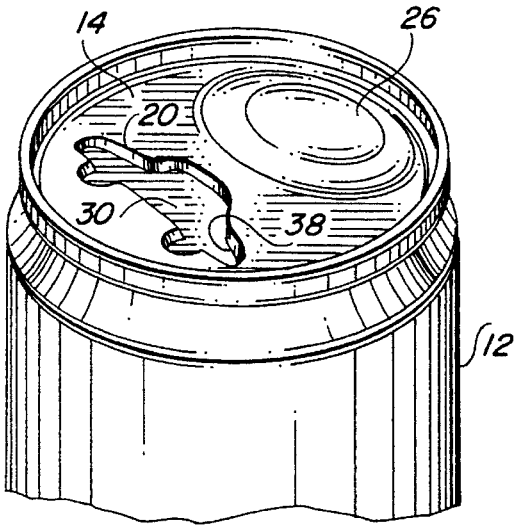

With reference to FIGS. 7*a* and 7*b*, in an alternate embodiment of the invention, the frangible member portion 30 will be ruptured in a manner so as to allow the frangible member portion 30 to remain partially fixed to the sheet member 22. In this embodiment, the cutting edge 38 is formed partially around the opening 20. A smooth edge 39 protects the frangible sheet member 22 against being severed. In this configuration, the frangible member portion 30 remains with the container 10 and eliminates the need for separate disposal of the ruptured member portion 30. Once the frangible member portion 30 has been partially severed as illustrated in FIG. 7*a*, the frangible member portion 30 can then be positioned within the container 10 and out of view by the user.

It is anticipated that a panel 14 will be placed at preferred locations on a container based on the use for such a container. In the embodiment described by way of example, the panel 14 serves as a can top. FIGS. 8*a* through 8*d* illustrated various geometric shapes used for the opening 20 in such a top for enhancing advertising features for the user of the easy open pressurized container 10 or to enhance promotion of the container contents. The invention supports a variety of openings 20 as well as variety in the shape of the protrusions 26 left only to imagination.

While a specific embodiment of the invention has been described in detail herein above, it is to be understood that various modifications may be made from the specific details described herein without departing from the spirit and scope of the invention as set forth in the appended claims.

Having now described the invention, the construction, the operation and use of preferred embodiments thereof are set forth in the appended claims.

What is claimed is:

1. An easy open container comprising:

a pressurized container;

a panel affixed to the pressurized container, the panel having an opening for passing contents of the container therethrough, the panel further having a cutting edge portion adjacent the opening, the cutting edge portion extending into the container;

a frangible member across the opening of the panel, the frangible member biased against the cutting edge portion; and means for increasing pressure within the pressurized container, wherein the increased pressure causes rupture of the frangible member outwardly from the container and away from the panel.

2. The container as recited in claim 1, wherein the increasing pressure means comprises:

a depressible portion extending from the panel, wherein depression of the depressible portion causes increased pressure within the container sufficient for rupturing the frangible member outwardly from the container and away from the panel.

3. The container as recited in claim 1, wherein the increasing pressure means comprises the container having side walls formed from material for depressing the side walls into the container, wherein the depressing of the side walls causes increased pressure within the container sufficient for rupturing the frangible member outwardly from the container and away from the panel.

4. The container as recited in claim 1, further comprising the frangible member across the panel for providing a seal between the panel and the pressurized container.

5. The container as recited in claim 4, wherein the frangible member comprises a sealing liner sheet having a pressure sensitive adhesive for affixing the sheet to the panel.

6. The container as recited in claim 1, wherein the opening comprises a distinguishable geometric form.

7. The container as recited in claim 1, wherein the container is dimensioned to be held in a hand for pouring material contained in the container out through the opening.

8. An easy open end for a pressurized container comprising:

an end panel having an opening, the panel further having a cutting edge portion adjacent the opening for extending into a container; a frangible member across the opening and biased against the cutting edge portion; and means for increasing pressure against the frangible member when the end panel is affixed to a pressurized container, wherein the increased pressure causes rupture of the frangible member outwardly from the container and away from the panel.

9. The easy open end as recited in claim 8, wherein the increasing pressure means comprises a depressible portion extending from the panel, wherein depression of the depressible portion causes increased pressure within the container sufficient for rupturing the frangible member outwardly from the container and away from the panel.

10. The container as recited in claim 8, wherein the increasing pressure means comprises the container having side walls formed from material for depressing the side walls into the container, wherein the depressing of the side walls causes increased pressure within the container sufficient for rupturing the frangible member outwardly from the container and away from the panel.

11. The container as recited in claim 8, further comprising the frangible member across the panel for providing a seal between the panel and the pressurized container.

12. The container as recited in claim 8, wherein the frangible member comprises a sealing liner sheet having a pressure sensitive adhesive for affixing the sheet to the panel.

13. The container as recited in claim 8, wherein the opening comprises a distinguishable geometric form.

14. The container as recited in claim 8, wherein the container is dimensioned to be held in a hand for pouring material contained in the container out through the opening.

15. A method for easily opening a container, the method comprising the steps of:

providing a pressurized container having an edge for affixing a panel thereto;

providing a panel for affixing to the pressurized container edge, the panel having an opening for passing contents of the container therethrough;

providing a cutting edge portion adjacent the opening;

extending the cutting edge portion into the container;

placing a frangible member across the opening of the panel;

biasing the cutting edge portion against the frangible member;

affixing the panel to the container edge; and increasing pressure within the pressurized container for rupturing the frangible member outwardly from the container and away from the panel, thus providing access into container through the panel opening.

16. The method as recited in claim 15, wherein the step of increasing pressure comprises the steps of:

forming a depressible portion extending from the panel; and depressing the depressible portion to increase the pressure within the container sufficient to rupture the frangible member outwardly from the container and away from the panel.

17. The method as recited in claim 15, wherein the step of increasing pressure comprises the step of depressing walls of the container into the container for increasing pressure within the container sufficient for rupturing the frangible member outwardly from the container and away from the panel.

18. The method as recited in claim 15, further comprising the step of placing the frangible member across the panel for sealing the panel to the pressurized container.

19. The method as recited in claim 15, further comprising the steps of:

providing a sealing liner sheet having a pressure sensitive adhesive; and affixing the sheet to the panel.

20. The method as recited in claim 15, further comprising the step of forming the opening into a distinguishable geometric form.

21. The method as recited in claim 15, further comprising the steps of:

dimensioning the container for holding the container in a hand;

holding the container in a hand;

increasing the pressure using a hand; and pouring contents of the container through the opening.

* * * * *